US008001813B1

(12) United States Patent
Turnbo

(10) Patent No.: US 8,001,813 B1
(45) Date of Patent: Aug. 23, 2011

(54) LEVER ACTIVATED DEADBOLT LOCK WITH DEADLOCK FEATURE

(76) Inventor: William Turnbo, Newbern, TN (US)

( * ) Notice: Subject to any disclaimer, the term of this patent is extended or adjusted under 35 U.S.C. 154(b) by 657 days.

(21) Appl. No.: 12/109,153

(22) Filed: Apr. 24, 2008

(51) Int. Cl.
*E05B 65/06* (2006.01)

(52) U.S. Cl. ..... 70/129; 70/134; 292/139; 292/167; 292/169

(58) Field of Classification Search ..... 70/129, 70/134; 292/139, 167, 169
See application file for complete search history.

(56) References Cited

U.S. PATENT DOCUMENTS

| | | | | | |
|---|---|---|---|---|---|
| 845,613 | A | * | 2/1907 | Caldwell | 70/129 |
| 913,459 | A | * | 2/1909 | Bily | 70/355 |
| 1,357,122 | A | * | 10/1920 | Schroeder | 70/156 |
| 1,699,370 | A | * | 1/1929 | Menzel | 70/129 |
| 2,865,666 | A | | 12/1958 | Kubik | |
| 2,878,049 | A | | 3/1959 | Linton | |
| 3,036,850 | A | * | 5/1962 | Schmid | 292/244 |
| 3,222,097 | A | | 12/1965 | Behrmann | |
| 3,711,139 | A | | 1/1973 | Polk, Jr. | |
| 3,851,325 | A | | 11/1974 | Maged | |
| 3,917,329 | A | | 11/1975 | Fujiki et al. | |
| 3,944,040 | A | | 3/1976 | Richard | |
| 4,272,974 | A | * | 6/1981 | Hennessy | 70/129 |
| 4,422,677 | A | * | 12/1983 | Gater | 292/139 |
| 4,601,502 | A | | 7/1986 | Van Dyke | |
| 4,656,849 | A | * | 4/1987 | Rotondi et al. | 70/134 |
| 4,682,482 | A | * | 7/1987 | Hall | 70/129 |
| 4,765,663 | A | | 8/1988 | Raymond et al. | |
| 4,772,055 | A | * | 9/1988 | Fang | 292/1.5 |
| 4,876,866 | A | * | 10/1989 | Fleming et al. | 70/379 R |
| 4,945,737 | A | * | 8/1990 | Hart | 70/143 |
| 4,949,562 | A | | 8/1990 | Thorncraft et al. | |
| 4,950,005 | A | | 8/1990 | Cudd | |
| 5,010,749 | A | | 4/1991 | Lin | |
| 5,058,940 | A | * | 10/1991 | Hart | 292/167 |
| 5,150,592 | A | | 9/1992 | Lin | |
| 5,186,030 | A | | 2/1993 | Lin | |
| 5,199,285 | A | | 4/1993 | Lin | |
| 5,315,850 | A | * | 5/1994 | Edeus et al. | 70/129 |
| 5,713,227 | A | | 2/1998 | Turnbo | |
| 2008/0022729 | A1 | * | 1/2008 | Middleton | 70/129 |

* cited by examiner

*Primary Examiner* — Suzanne Barrett
(74) *Attorney, Agent, or Firm* — Waddey & Patterson; Mark J. Patterson; Matthew C. Cox

(57) ABSTRACT

To prevent intruders from forcing a deadbolt out of a locking position, the deadbolt has a sleeve defining inside and outside slots. Each of these slots has a horizontal section and a locked position vertical section. Cross members extend through the slots and are placed in the locked position vertical sections when the deadbolt is in the locked position. This prevents the deadbolt from being forcibly unlocked.

6 Claims, 8 Drawing Sheets

LEVER ACTIVATED DEADBOLT LOCK WITH DEADLOCK FEATURE

BACKGROUND OF THE INVENTION

The present invention relates generally to a deadbolt lock for a door.

More particularly, this invention pertains to deadbolt locks that prevent the deadbolt from being forced out of a locking position.

Deadbolts are designed to prevent an intruder from entering a home or business. By locking the door and placing the deadbolt within a bore in the doorframe, an intruder is prevented from entering the home. Unfortunately, intruders and thieves have figured out how to force these deadbolts out of the locked position.

What is needed, then, is a mechanism that prevents deadbolt locks from being forced out of the locked position by thieves.

BRIEF SUMMARY OF THE INVENTION

A deadbolt lock that prevents a deadbolt from being moved into an unlocked position is shown and described. The deadbolt is slidably mounted in a sleeve that defines an inside slot and an outside slot each having a horizontal section and locked position vertical section. Attached to the deadbolt is an inside cross member portion that extends through the inside slot and into a cavity within the lock. On the other side of the deadbolt is an outside cross member portion that extends through the outside slot which is exposed to the outside of the lock. These cross member portions slide through the slots as the deadbolt is moved from an unlocked position to a door locking position. When the deadbolt is in the locked position, the cross member portions are moved into the locked position vertical sections of their respective slots. The intersection between the cross member portions and the locked position vertical sections prevents intruders from forcing the deadbolt out of the locked position.

The lock may also include a faceplate on the housing for the lock mounted on the interior side of the door. This faceplate may also define a slot with a horizontal section and a vertical section. The outside cross member portion extends out of the faceplate slot and is placed in the vertical section of the faceplate slot when the deadbolt is in the locking position. This also prevents the deadbolt from being moved out of the locked position.

To move the deadbolt out of the door locking position and into and out of the locked position, activators are positioned on the lock to engage the inside cross member portion in the locked and unlocked positions. The activators force each cross member portion out of the vertical sections and into the horizontal sections of the slots. In this manner, the cross member portions can slide through the horizontal sections of each of the slots so that the deadbolt can be moved into and out of the locked and unlocked positions.

DETAILED DESCRIPTION OF THE INVENTION

Figure 1:
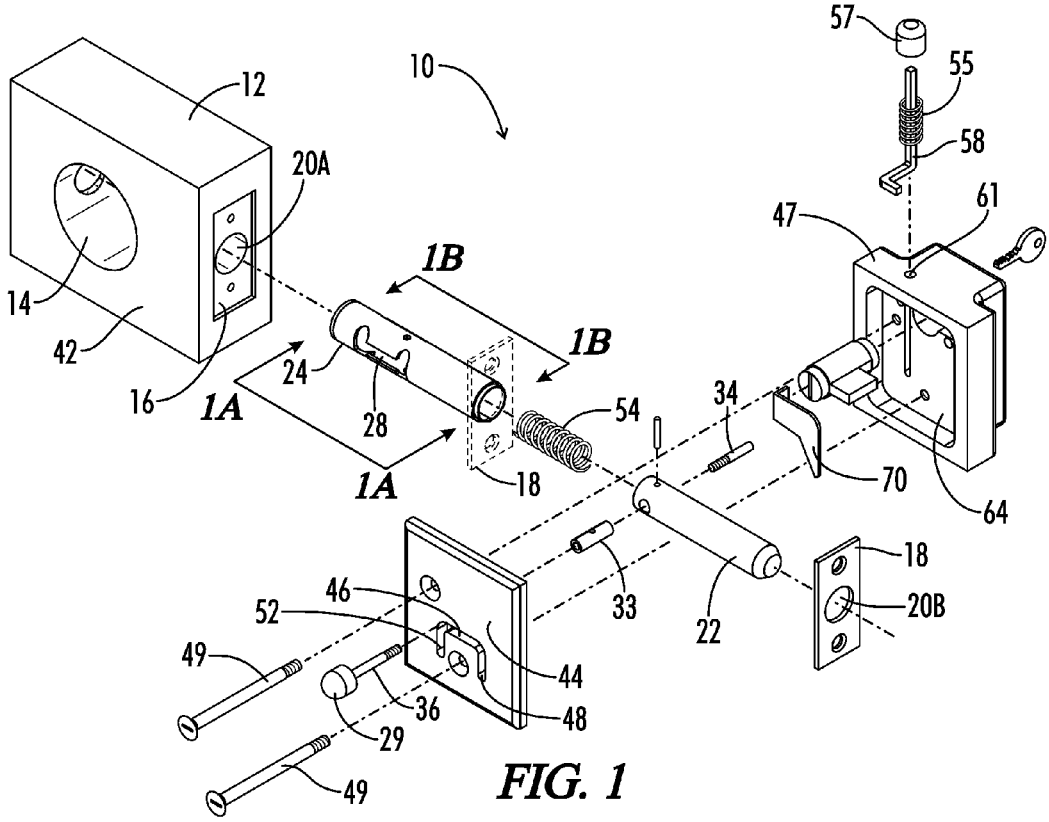
FIG. 1 is an exploded perspective view of one embodiment of the deadbolt lock of the present invention.
Figure 2:
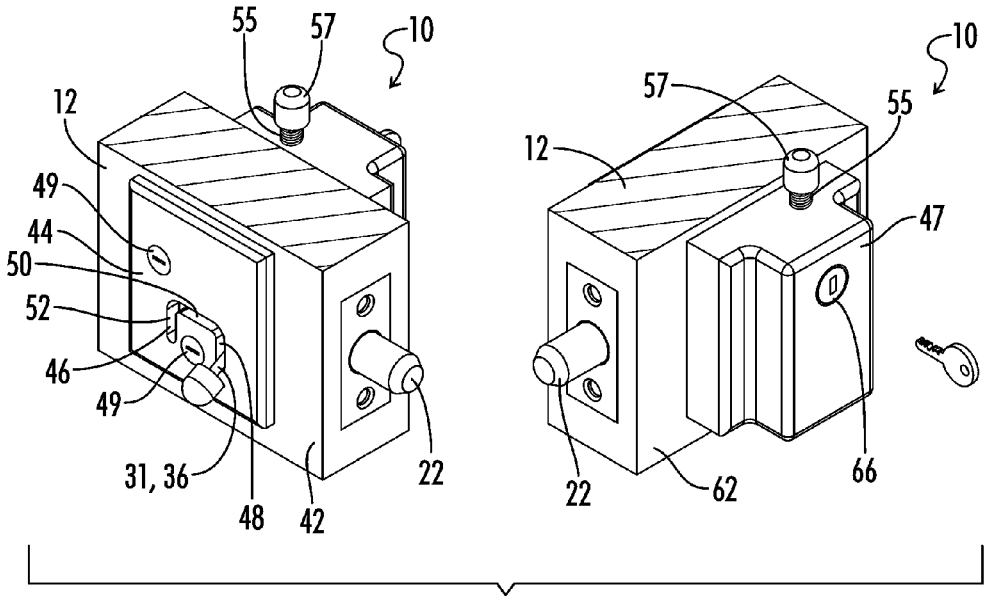
FIG. 2 is a perspective view of both sides of the exterior of the deadbolt lock shown in FIG. 1 when the deadbolt is in the unlocked position.
Figure 3:
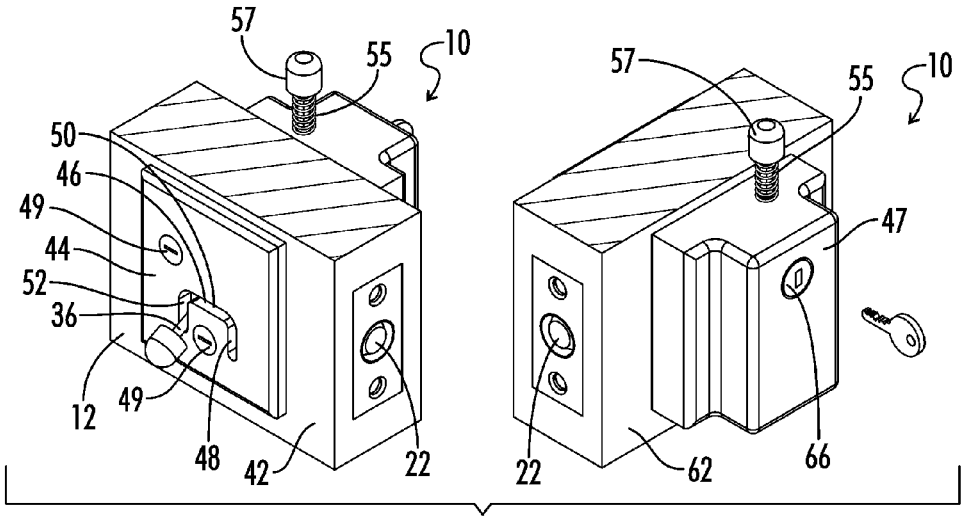
FIG. 3 is a perspective view of both sides of the outside of the deadbolt lock shown in FIG. 1 when the deadbolt is in the locked position.

Referring now to FIG. 1, the illustrated embodiment of the deadbolt lock 10 is mounted on the door 12 in a conventional manner. Specifically, the components of the lock 10 are mounted within a large bore 14 in the interior of the door 12. The side of door 13 forms a depression 16 having a deadbolt bore 20A. A latching plate 18 is placed within the depression 16 and fastened via screws or the like within the depression 16. The latching plate 18 also defines a deadbolt bore 20B that aligns with the deadbolt bore 20A in the depression 16 on the side of door 13. To lock the door 12, the deadbolt 22 slides through these bores 20A, 20B and into a bore on the doorframe (not shown). The deadbolt 22 is thus in the door locking position, as shown in FIG. 2, when it is extended through the bores 20A, 20B and into the bore on the doorframe. In the unlocked position, as shown in FIG. 3, the deadbolt 22 is slid into the interior of the lock 10 through the aligned bores 20A, 20B so that the door 12 can be opened.

Figure 1A:
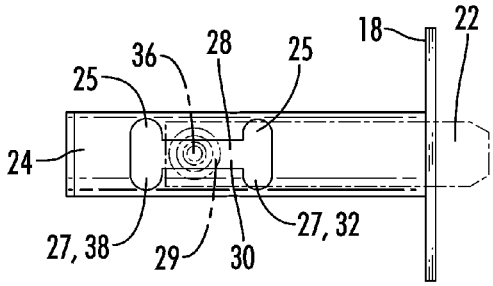
FIG. 1A shows an outside slot on the side of a sleeve for the deadbolt lock shown in FIG. 1.
Figure 1B:
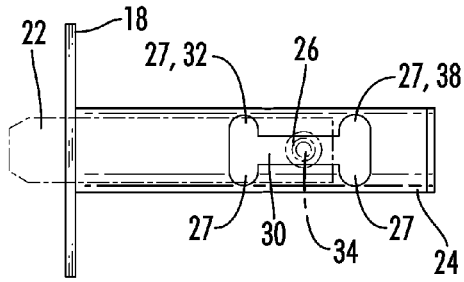
FIG. 1B shows an inside slot on the other side of the sleeve for the deadbolt lock shown in FIG. 1

Referring now to FIGS. 1, 1A and 1B, the deadbolt 22 is slidably mounted within a sleeve 24 so that the deadbolt 22 can be moved into and out of the locking position. The sleeve 24 defines an inside slot 26 (shown in FIG. 1B) positioned inside the cavity 64 of the lock 10 and an outside slot 28 exposed to the outside of the lock 10. To assure that the deadbolt 22 cannot be forced out of the locking position, each of the slots 26, 28 define a horizontal section 30 and a locked position vertical section 32. Cross member portions 34, 36 are attached to the deadbolt 22 and extend through the slots 26, 28. The cross member portions 34, 36 may be fastened to the deadbolt 22 via engagement member 33 which is insertable within the deadbolt 22.

As will be described in more detail below, the cross member portions 34, 36 slides through respective slots 26, 28 as the deadbolt 22 slides in and out of the door locking position. In the door locking position, cross member portions 34, 36 are placed within the locked position vertical section 32 of their respective slots 26, 28. This prevents the deadbolt 22 from being forced out of the door locking position because any force upon the deadbolt 22 is obstructed by the intersection between the cross member portions 34, 36 and the locked position vertical sections 32.

Each slot 26, 28 may also define an unlocked position vertical section 38. The cross member portions 34, 36 are placed within the unlocked position vertical sections 38 when the deadbolt 22 is in the unlocked position. Horizontal sections 30 separate the vertical sections 32, 38. As the deadbolt 22 is moved from the locked position to the unlocked position, the cross member portions 34, 36 slide from the locked position vertical section 32 to the unlocked position vertical section 38 through the horizontal section 30.

FIGS. 1A and 1B show the slots 26, 28 in a double T configuration having upper and lower grooves 25, 27 on both ends of the slots 26, 28. Attached to the outside cross member portion 36 is a weight 29 (also shown in FIG. 1) that assists in placing the cross member portions 34, 36 within the unlocked position and locked position vertical sections 32, 38. When the cross members 34 and 36 are being transferred from the horizontal sections 30 into one of the vertical sections 32, 38, the attached weight 29 will cause the outside cross member portion 36 to drop into one of the lower grooves 27 of the outside slot 28. This will cause a rotation of the deadbolt 22 which places the inside cross member portion 34 into one of the upper grooves 25 of the inside slot 26. Although the illustrated embodiment places the outside cross member portion 36 in the lower groove 27 of the T configuration and the inside cross member portion 34 in the upper groove 25 of the double T configuration, the double T configuration allows the cross member portions 34, 36 to be rotated either upwards or downwards on either side of the sleeve 24. Thus, the weight 29 could also be placed on the inside cross member portion 34 to achieve the opposite action.

Referring now to FIGS. 1, 2, and 3, the deadbolt lock 10 may also have a faceplate 44 that also defines a slot 46 on the interior side 42 of the door 12. In this embodiment, the slot 46 on the faceplate 44 exposes the outside slot 28 to the exterior of the lock 10. Because of this, the outside cross member portion 36 can extend through the slot 46 and is accessible from outside the lock 10. Similar to the slots 26, 28, on the sleeve 24, this slot 46 also has a locked position vertical section 48, a horizontal section 50, and an unlocked position vertical section 52. The outside cross member portion 36 extends through this slot 46 and also prevents the deadbolt 22 from being forced out of the door locking position when the deadbolt 22 is in the locked position vertical section 48 of the faceplate 44. Fasteners 49 are inserted through the faceplate 44 and into the housing 47 of the deadbolt lock 10 to attach the faceplate 44.

As shown in FIGS. 1A, 1B, 2 and 3, one way to move the deadbolt 22 into and out of the door locking position is by grabbing the outside cross member portion 36 and sliding the outside cross member portion 36 through the faceplate slot 46 in the housing 47. This action allows the deadbolt 22 to be moved from the locked to the unlocked position. When the outside cross member portion 36 is moved out of the locked position vertical section 48 on the faceplate 44, both cross member portions 34, 36 are also moved out of the locked position vertical sections 32 on the sleeve 24. By sliding the outside cross member portion 36 through the horizontal section 50 on the faceplate 44, both cross member portions 34, 36 are slid through the horizontal sections 30 on the sleeve. The deadbolt 22 thus slides into an unlocking position and the outside cross member portion 36 can be positioned in the unlocked position vertical section 52 on the faceplate 44 thereby placing the cross member portions 34, 36 into their respective unlocked position vertical sections 38 on the sleeve. The outside cross member portion 36 will thus normally be placed on the side of the lock 10 mounted on the interior side 42 of the door 12. This allows a user to easily lock and unlock the door 12 from inside of the home or building.

Referring to FIGS. 1, 1A, and 1B, the lock 10 also has a mechanism for easily locking the deadbolt 22 from outside the home or building. To accomplish this, a resilient component 54, such as a spring, may be mounted between a wall 56 on the sleeve 24 and the deadbolt 22. As will be described below, once the cross member portions 34, 36 are in the horizontal sections 30, the resilient component 54 expands and propels the deadbolt 22 into the locked position.

Next, as shown in FIGS. 1, 1A, 1B, 2, and 3, in order to move the cross member portions 34, 36 from the unlocked position vertical sections 32 to the horizontals sections 30, the lock 10 may have an activator 58 which in this embodiment is an L-shaped lever. The activator 58 is inserted through an aperture 61 in the housing 47 to extend into the cavity 64 within the lock 10. The activator 58 also extends out of the housing 47 on the exterior side 62 of the door 12. Another resilient member 55 is positioned on the activator 58 between the housing 47 and a top stopper 57 of the activator 58. The activator 58 may then be pressed toward the housing 47 to place the deadbolt 22 in locked position. The resilient member 55 will then cause the activator 58 to return to its original position after the activator 58 has been pressed.

Figure 4:
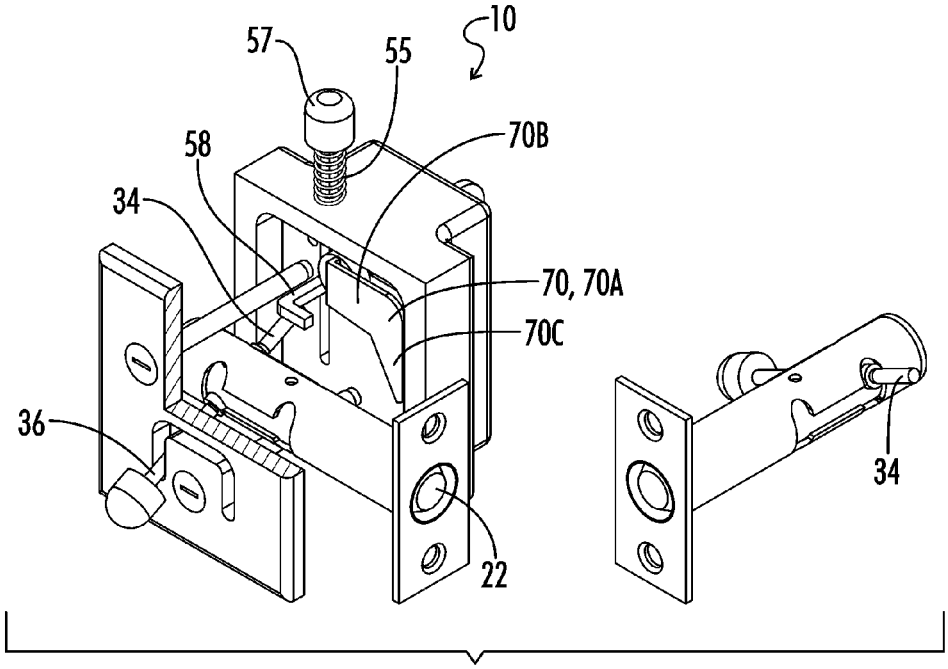
FIG. 4 is an exploded perspective view illustrating the inside of the deadbolt lock shown in FIG. 1 before the deadbolt has been moved from the unlocked position to the locked position, the left side of FIG. 4 showing the side of the sleeve with the outside slot and the right side of FIG. 4 showing the side of the sleeve with the inside slot.
Figure 5:
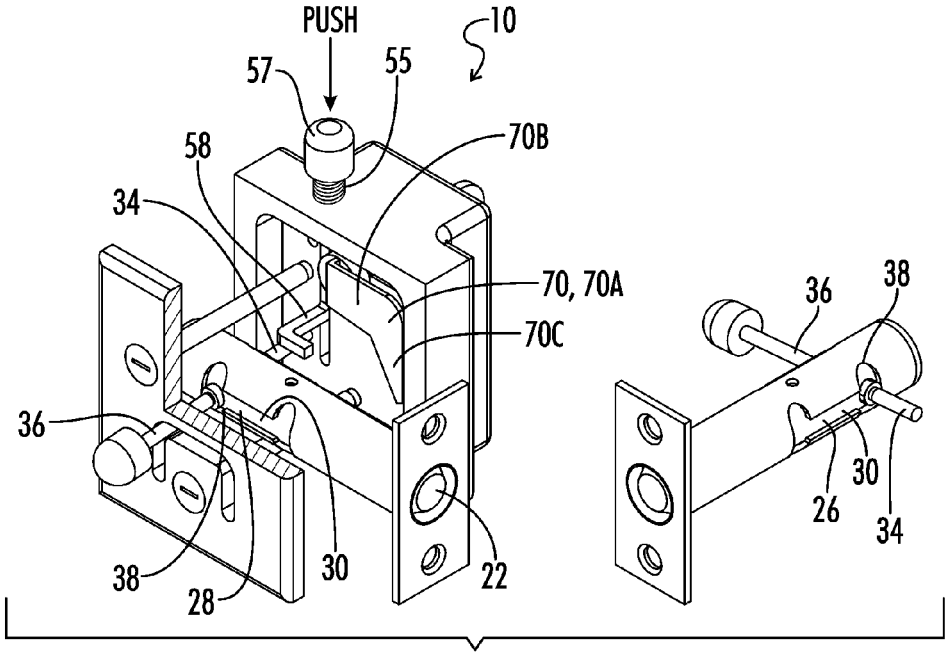
FIG. 5 is an exploded perspective view illustrating the inside of the deadbolt lock shown in FIG. 1 as the first activator moves the cross members out of the unlocked position vertical section when the deadbolt lock is being moved into the locked position. The left side of FIG. 5 shows the side of the sleeve with the outside slot and the right side of FIG. 5 shows the side of the sleeve with the inside slot.
Figure 6:
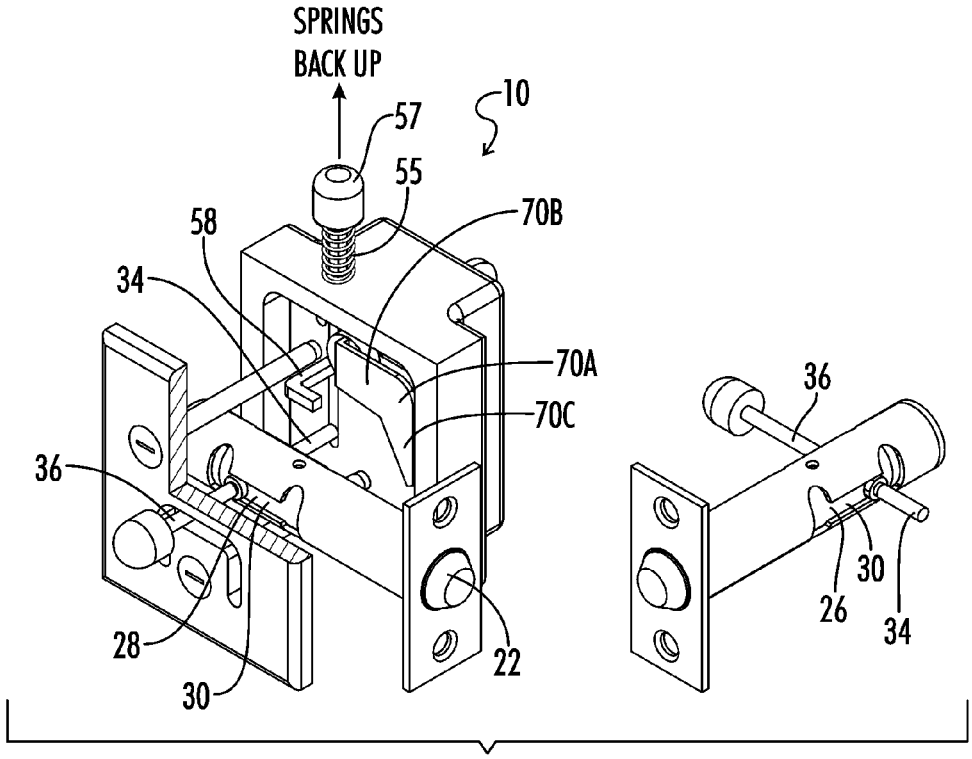
FIG. 6 is an exploded perspective view illustrating the inside of the deadbolt lock shown in FIG. 1 with the cross members positioned in the horizontal section of the slots when the deadbolt lock is being moved into the locked position. T. The left side of FIG. 6 shows the side of the sleeve with the outside slot and the right side of FIG. 6 shows the side of the sleeve with the inside slot.
Figure 7:
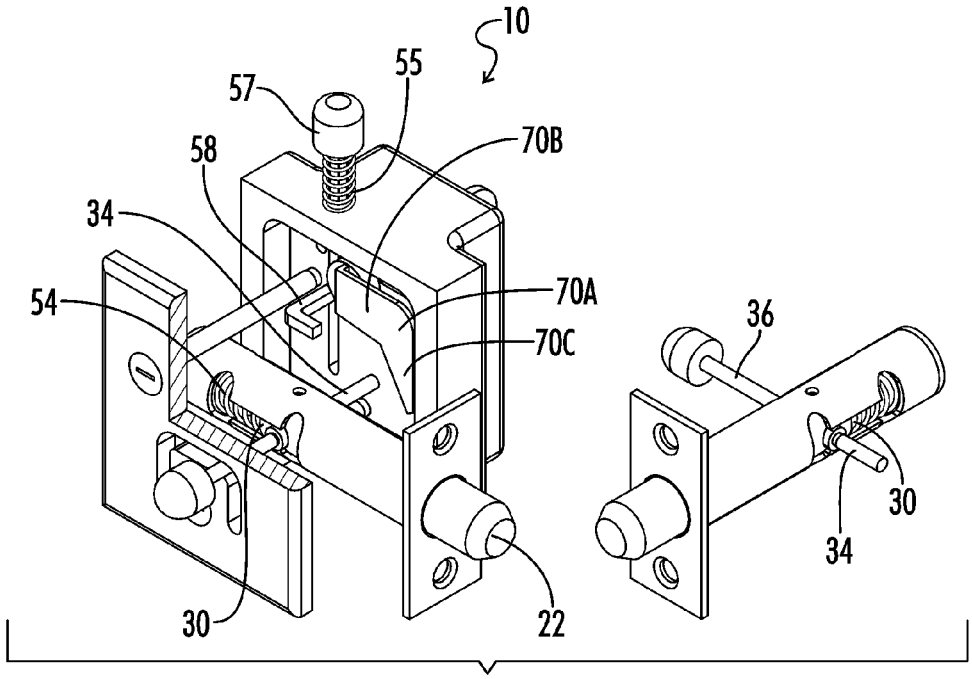
FIG. 7 is an exploded perspective view illustrating the inside of the deadbolt lock shown in FIG. 1 as the resilient member propels the cross members through the horizontal section of the slots when the deadbolt lock is being moved into the locked position. The left side of FIG. 7 shows the side of the sleeve with the outside slot and the right side of FIG. 7 shows the side of the sleeve with the inside slot.
Figure 8:
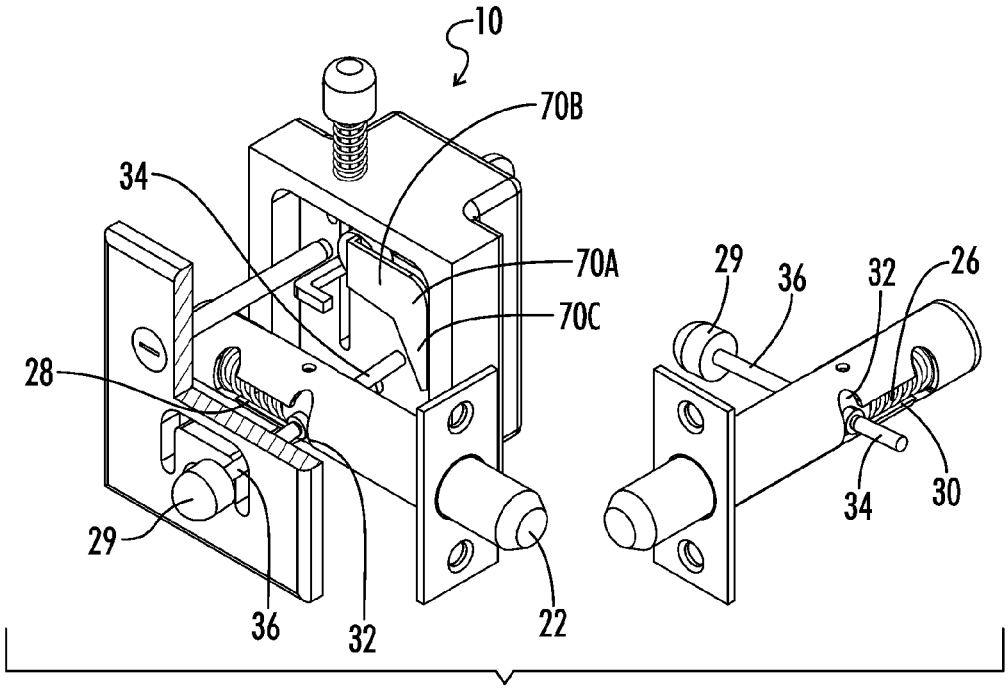
FIG. 8 is an exploded perspective view illustrating the inside of the deadbolt lock shown in FIG. 1 as the cross members are moved from the horizontal sections of the slots to the locked position vertical sections when the deadbolt lock is being moved into the locked position. The left side of FIG. 8 shows the side of the sleeve with the outside slot and the right side of FIG. 8 shows the side of the sleeve with the inside slot.
Figure 9:
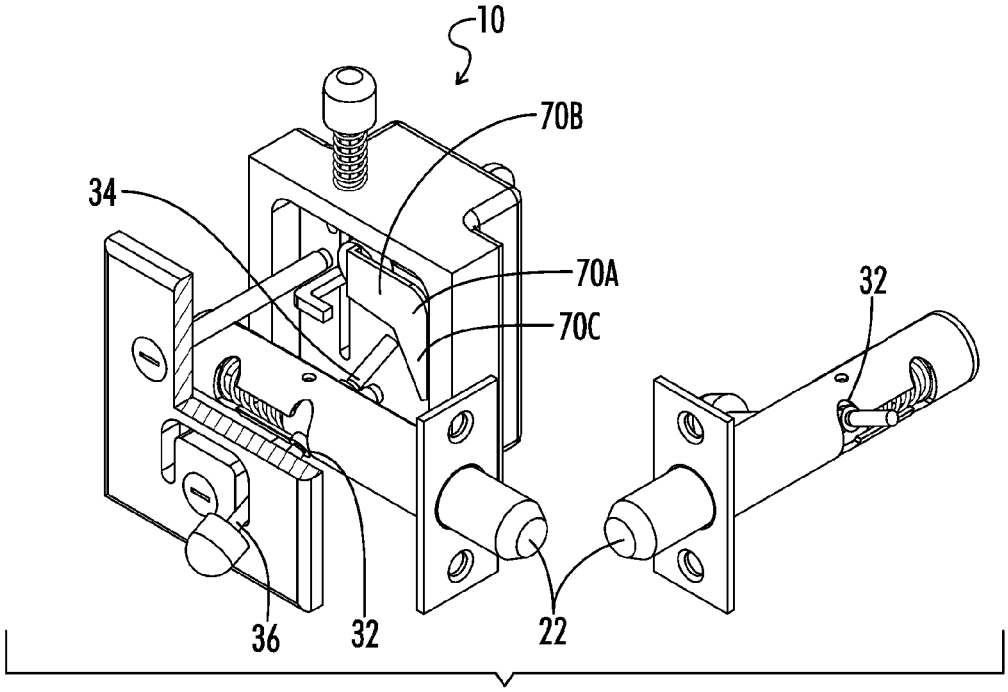
FIG. 9 is an exploded perspective view illustrating the inside of the deadbolt lock shown in FIG. 1 when the deadbolt lock is in the locked position. The left side of FIG. 9 shows the side of the sleeve with the outside slot and the right side of FIG. 9 shows the side of the sleeve with the inside slot.

FIGS. 4-9 illustrate the operation of the mechanism on the interior of the deadbolt lock 10 for locking the door 12. FIG. 4 shows the inside of one embodiment of the lock 10 in the unlocked position having the activator 58 positioned above the inside cross member portion 34. As shown in FIG. 5, to initiate the unlocking of the deadbolt lock 10, the activator 58 is pressed toward the inside cross member portion 34. This causes the activator 58 to engage the inside cross member portion 34 thereby forcing each cross member portion 34, 36 from the unlocked position vertical sections 38 into the horizontal sections 30 of each slot 26, 28. This compresses the resilient member 55 on the activator 58. As shown in FIG. 6, once the cross member portions 34, 36 are in the horizontal sections 30, the tension in the resilient member 55 on the activator 58 is released and the activator 58 is returned to its original position. In the next step, shown in FIG. 7, the tension in the resilient component 54 in the sleeve 24 is then released to propel the deadbolt 22 into the locked position. Next, FIG. 8 shows the cross member portions 34, 36 after the cross member portions 34, 36 slide through the horizontal sections 30. At this point, the cross member portions 34, 36 become aligned with the locked position vertical sections 32. The weight 29 then causes the outside cross member portion 36 to drop into the locked position vertical section 32 on the outside slot 28. This thereby causes the deadbolt 22 to rotate and place the inside cross member portion 34 in the locked position vertical section 32 of the inside slot 26. As shown in FIG. 9, the deadbolt 22 is now in the locked position and cannot forced into the unlocked position because of the intersection between the cross member portions 34, 36 and the locked position vertical sections 32. Referring again to FIGS. 4-9, as the deadbolt 22 is moved into the locked position, the inside cross member portion 34 is moved toward a second activator 70. This second activator 70 is utilized to move the deadbolt 22 into the unlocked position and in this embodiment is a cammed member 70A having an upper and lower portion 70B, 70C.

Figure 10:
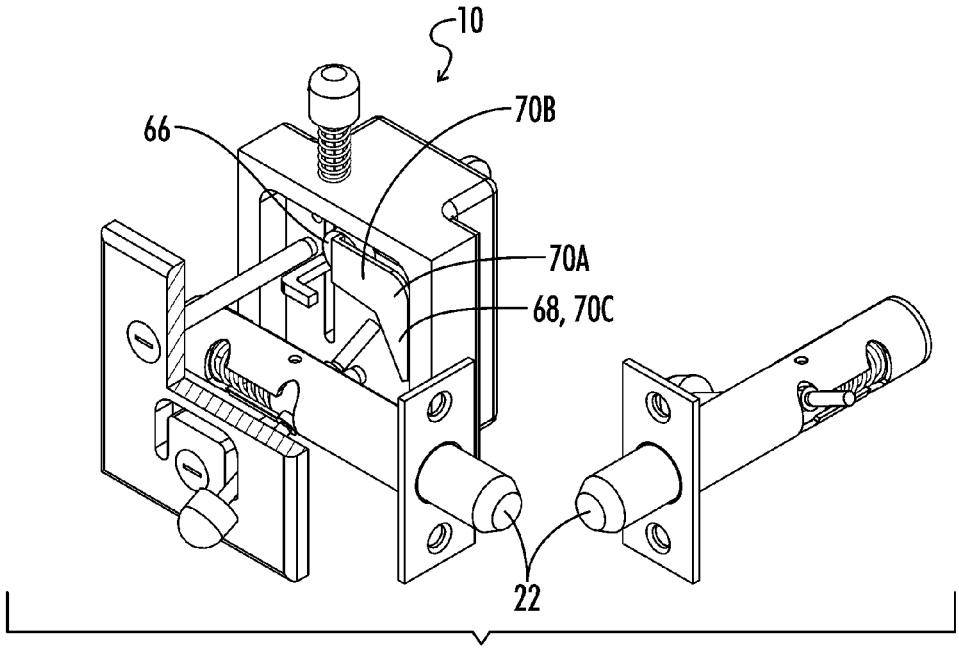
FIG. 10 is an exploded perspective view illustrating the inside of the deadbolt lock shown in FIG. 1 before the deadbolt lock has been moved from the locked position into the unlocked position. The left side of FIG. 10 shows the side of the sleeve with the outside slot and the right side of FIG. 10 shows the side of the sleeve with the inside slot.
Figure 11:
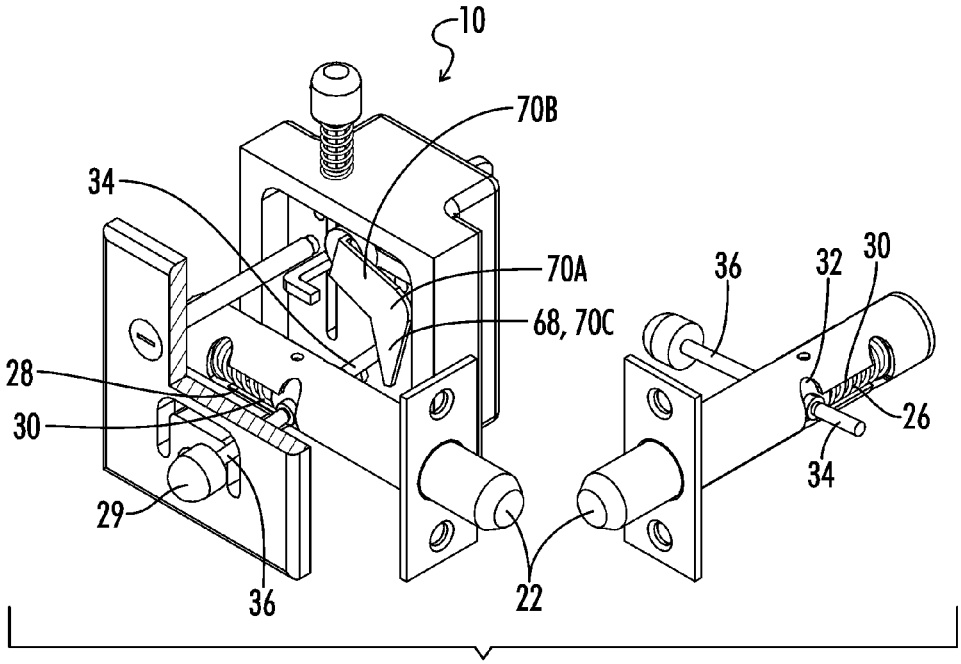
FIG. 11 is an exploded perspective view illustrating the inside of the deadbolt lock shown in FIG. 1 as a second activator moves the cross members from the locked position vertical sections of the slots to the horizontal sections of the slots when the deadbolt lock is being moved into the unlocked position. The left side of FIG. 11 shows the side of the sleeve with the outside slot and the right side of FIG. 11 shows the side of the sleeve with the inside slot.
Figure 12:
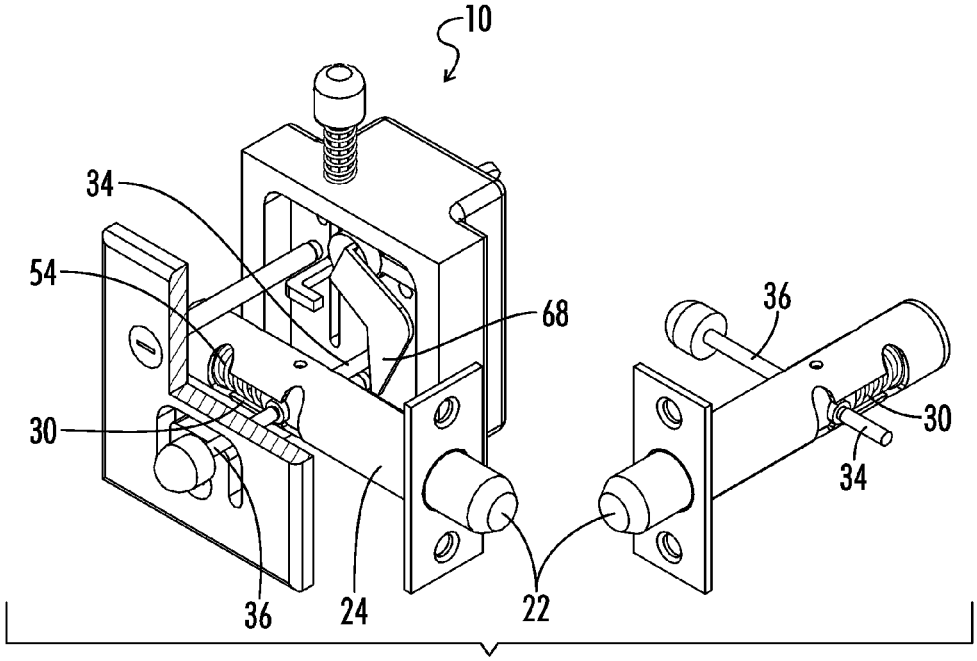
FIG. 12 is an exploded perspective view illustrating the inside of the deadbolt lock shown in FIG. 1 with the cross members in the horizontal sections of the slots when the deadbolt lock is being moved into the unlocked position. The left side of FIG. 12 shows the side of the sleeve with the outside slot and the right side of FIG. 12 shows the side of the sleeve with the inside slot.
Figure 13:
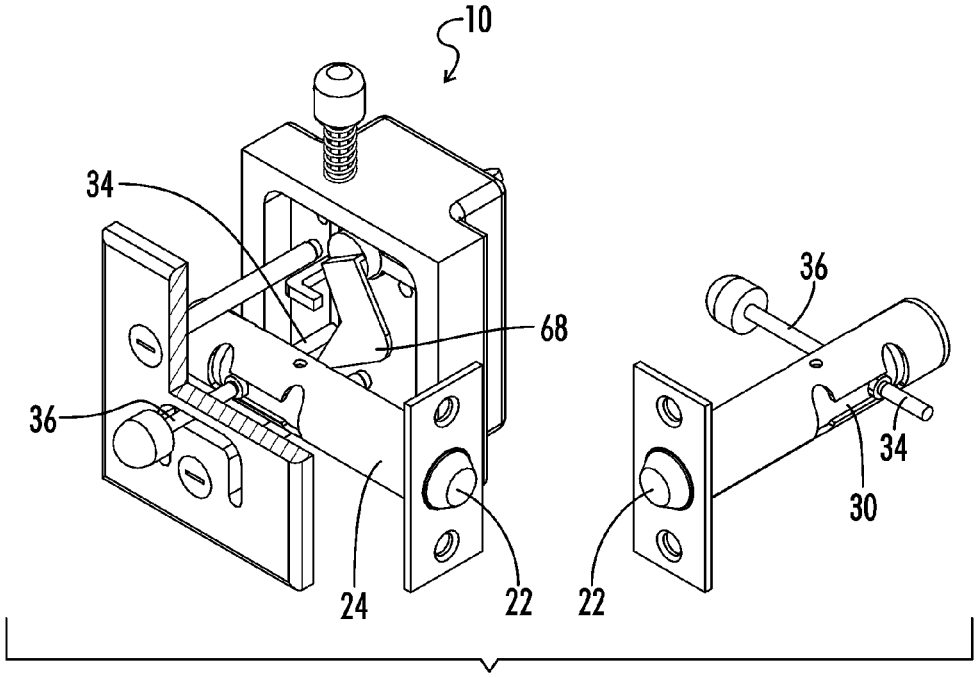
FIG. 13 is an exploded perspective view illustrating the inside of the deadbolt lock shown in FIG. 1 as the second activator moves the cross members through the horizontal sections of the slots to contract the resilient member when the deadbolt lock is being moved into the unlocked position. The left side of FIG. 13 shows the side of the sleeve with the outside slot and the right side of FIG. 13 shows the side of the sleeve with the inside slot.
Figure 14:
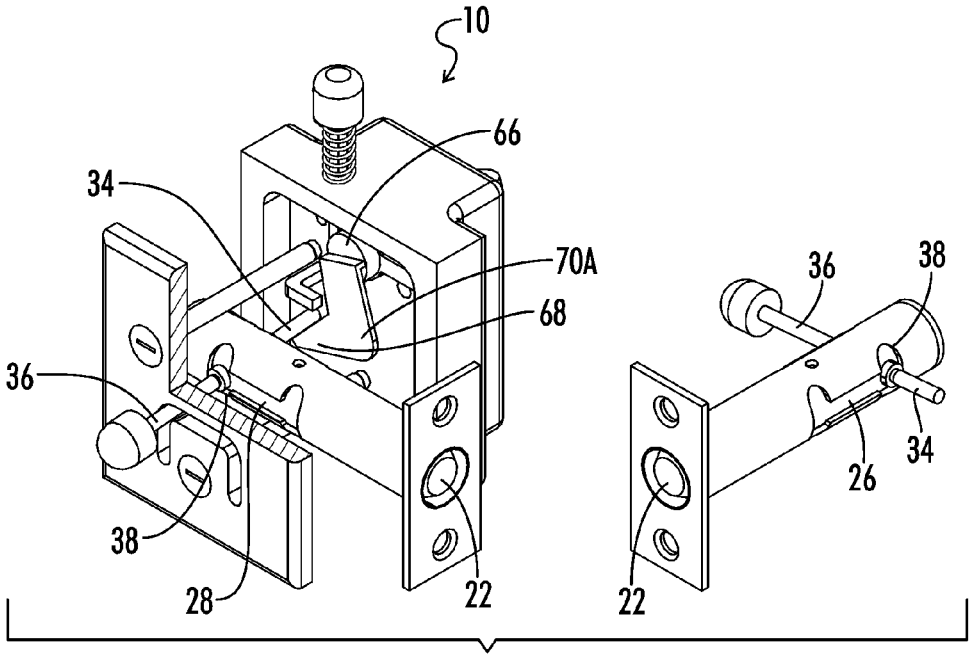
FIG. 14 is an exploded perspective view illustrating the inside of the deadbolt lock shown in FIG. 1 as the cross members are being moved from the horizontal sections of the slots into the unlocked position vertical sections of the slots when the deadbolt lock is being moved into the unlocked position. The left side of FIG. 14 shows the side of the sleeve with the outside slot and the right side of FIG. 14 shows the side of the sleeve with the inside slot.
Figure 15:
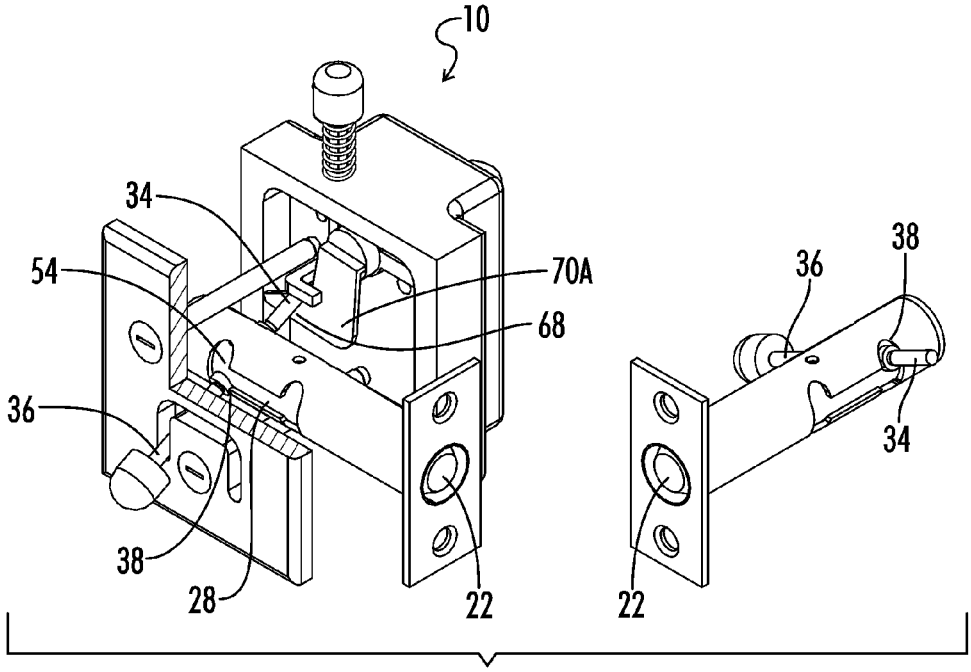
FIG. 15 is an exploded perspective view illustrating the inside of the deadbolt lock shown in FIG. 1 in the unlocked position. The left side of FIG. 15 shows the side of the sleeve with the outside slot and the right side of FIG. 15 shows the side of the sleeve with the inside slot.

FIGS. 10-15 show how the deadbolt lock 10 operates to move the deadbolt 22 into the unlocked position. As shown in FIG. 10, the upper portion 70B of the cammed member 70A is connected to a key acceptor 66 (the key acceptor 66 is also shown in FIGS. 2 and 3). As shown in FIG. 11, the lower portion 70C of the cammed member 70A operates as an arm 68 for moving the inside cross member portion 34 out of locked position vertical section 32 on the inside slot 26 into the horizontal sections 30. This thereby causes the deadbolt 22 to rotate and to place the outside cross member portion 36 in the horizontal section 30 of the outside slot 28. Next, as illustrated in FIGS. 12 and 13, once the cross member portions 34, 36 are in the horizontal sections 30, the arm 68 grabs the inside cross member portion 34 to slide the cross member portions 34, 36 through the horizontal sections 30. This pushes the deadbolt 22 into the unlocked position and compresses the resilient member 54 in the sleeve 24. In FIGS. 14 and 15, the cross member portions 34, 36 become aligned with the unlocked position vertical sections 38 and the weight 29 causes the outside cross member portion 36 to drop into the unlocked position vertical section 38 on the outside slot 28. This rotates the deadbolt 22 and places the inside cross member portion 34 into the unlocked position vertical section 38 on the inside slot 26. The cammed member 70A may also be positioned so that the rotation of the arm 68 moves the inside cross member portion 34 into the inside slot 26. Once the door 12 is unlocked, the key acceptor 66 is rotated to place the cammed member 70A back into its original position, as shown in FIG. 4.

Thus, although there have been described particular embodiments of the present invention of a new and useful Lever Activated Deadbolt Lock with Deadbolt Feature, it is not intended that such references be construed as limitations upon the scope of this invention except as set forth in the following claims.

What is claimed is:

1. A deadbolt lock for a door, comprising:

a sleeve defining an inside slot within the lock and an outside slot exposed to the outside of the lock, each slot having a locked position vertical section and a horizontal section;

a deadbolt slidably mounted within the sleeve;

an outside cross member portion attached to the deadbolt and extending through the outside slot;

an inside cross member portion attached to the deadbolt and extending through the inside slot, the deadbolt being in a door locking position when each cross member is moved from the horizontal section to the locked position vertical section of the respective slot, the vertical sections thereby preventing the deadbolt from being moved into an unlocked position;

an activator mounted within the lock, the activator being positioned to engage the inside cross member portion so that moving the activator forces each cross member portion from the locked position vertical section into the horizontal section whereby the deadbolt can be moved to the unlocked position;

wherein each slot further comprises an unlocked position vertical section, the horizontal section of each slot separating the unlocked position and locked position vertical sections, the deadbolt being in the unlocked position when the cross members are placed in the unlocked position vertical sections; and a second activator, the second activator being positioned so that rotating the second activator forces the cross members from the unlocked position vertical section into the horizontal section.

2. The deadbolt lock of claim 1, wherein the second activator comprises a lever.

3. A deadbolt lock for a door, comprising:

a sleeve defining an inside slot within the lock and an outside slot exposed to the outside of the lock, each slot having a locked position vertical section and a horizontal section;

a deadbolt slidably mounted within the sleeve;

an outside cross member portion attached to the deadbolt and extending through the outside slot;

an inside cross member portion attached to the deadbolt and extending through the inside slot, the deadbolt being in a door locking position when each cross member is moved from the horizontal section to the locked position vertical section of the respective slot, the vertical sections thereby preventing the deadbolt from being moved into an unlocked position;

an activator mounted within the lock, the activator being positioned to engage the inside cross member portion so that moving the activator forces each cross member portion from the locked position vertical section into the horizontal section whereby the deadbolt can be moved to the unlocked position;

wherein each slot further comprises an unlocked position vertical section, the horizontal section of each slot separating the unlocked position and the locked position vertical sections, the deadbolt being in the unlocked position when the cross members are placed in the unlocked position vertical sections; and a key acceptor coupled to the second activator so that rotating the key acceptor rotates the second activator.

4. The deadbolt lock of claim 3, further comprising the second activator further comprising an arm rotatably coupled to the key acceptor, the arm engaging the inside cross member portion so that the rotation of the arm moves the deadbolt into the unlocked position.

5. A deadbolt lock for a door, comprising:

a sleeve defining a wall and a slot, the slot having a locked position vertical section and a horizontal section;

a deadbolt slidably mounted within the sleeve;

a cross member attached to the deadbolt and extending through the slot, the deadbolt being moved into a locked position when the cross member is moved from the horizontal section to the locked position vertical section of the slot whereby the locked position vertical section prevents the deadbolt from being forced into an unlocked position;

a resilient component mounted between the wall and the deadbolt, wherein the expansion of the resilient component propels the deadbolt into the locked position;

the cross member including an outside cross member portion extending outside of the lock;

a weight disposed on the cross member outside portion;

a key acceptor mounted on the lock;

the slot defining an unlocked position vertical section; and the rotatable component further comprising a rotatable arm wherein the arm engages the cross member in the horizontal section and the rotation of the arm places the cross member in the unlocked position vertical section.

6. A deadbolt lock for a door, comprising:

a sleeve defining an inside slot within the lock and an outside slot exposed to the outside of the lock, each slot having a locked position vertical groove and a horizontal passage;

a deadbolt slidably mounted within the sleeve;

an outside cross member portion attached to the deadbolt and extending through the outside slot;

an inside cross member portion attached to the deadbolt and extending through the inside slot, the deadbolt being in a door locking position when each cross member is moved from the horizontal passage to the locked position vertical groove of the respective slot, the vertical groove thereby preventing the deadbolt from being forced into an unlocked position;

an activator mounted within the lock, the activator being positioned to engage the inside cross member portion so that moving the activator forces each cross member portion from the locked position vertical groove into the horizontal passage whereby the deadbolt can be moved to the unlocked position:

wherein each slot further comprises an unlocked position vertical groove, the horizontal passage of each slot separating the unlocked position and locked position vertical grooves, the deadbolt being in the unlocked position when the cross members are placed in the unlocked position vertical sections; and a second activator, the second activator being positioned so that moving the activator forces the cross members from the unlocked position vertical grooves into the horizontal passage.

* * * * *